US006074406A

United States Patent [19]

Mann

[11] Patent Number: 6,074,406

[45] Date of Patent: Jun. 13, 2000

[54] ENCLOSED CLUTCH FOR A PIERCING EARRING AND AN INTEGRATED DISPOSABLE CARTRIDGE CONTAINING THE SAME

[75] Inventor: Samuel J. Mann, Englewood, N.J.

[73] Assignee: Inverness Corporation, Fair Lawn, N.J.

[21] Appl. No.: 09/099,926

[22] Filed: Jun. 18, 1998

[51] Int. Cl.[7] ..... A61B 17/34

[52] U.S. Cl. ..... 606/188

[58] Field of Search ..... 606/184–188

[56] References Cited

U.S. PATENT DOCUMENTS 3,943,935 3/1976 Cameron .

4,030,507 6/1977 Mann ..... 606/188

4,986,829 1/1991 Blomdahl ..... 606/188

*Primary Examiner*—Michael Buiz

*Assistant Examiner*—William W. Lewis

*Attorney, Agent, or Firm*—Stroock & Stroock & Lavan LLP

[57] ABSTRACT

A clutch for a piercing earring having a piercing pin comprising a head portion having an internal end wall; a piercing pin positioning structure within the head portion for receiving and positioning a piercing pin having a piercing end point within the head portion; the piercing pin being stopped from further travel when the piercing end point contacts the internal end wall; and the head portion preventing the piercing pin from contacting a user when received within the head portion.

6 Claims, 7 Drawing Sheets

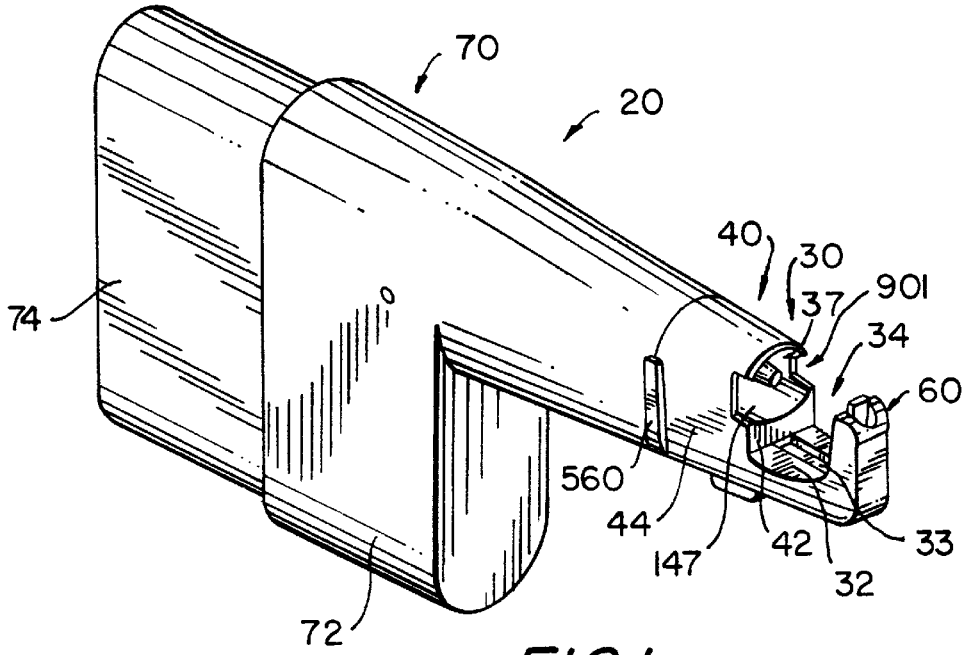
FIG. 1
FIG. 2
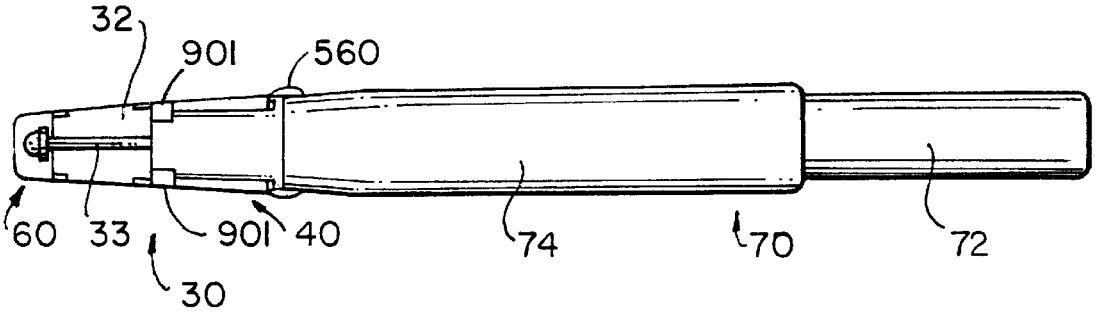

57b
900
900
57a 353
57b
56b
163
48b
54
55b
51
54a
47
55
50a
55a
48a
52a
58a
161
57a
56a
49
44
46
30
40
560
901
34
32
60
63
67
70
E
113
110
76
80
43
82
81
85
87
88
850
118
120
570
810
208
122
100
86
83
112
78
164
116
74
73
72
570
200
202
206
126
130
121

ENCLOSED CLUTCH FOR A PIERCING EARRING AND AN INTEGRATED DISPOSABLE CARTRIDGE CONTAINING THE SAME

BACKGROUND OF THE INVENTION

This invention is directed to an enclosed clutch for a piercing earring, and in particular to a disposable earlobe piercing earring and blind clutch cartridge.

The most recent prior art ear piercing systems are of two types, namely cartridge housed earrings and open earrings. Both types operate by inserting a pointed earring or stud through the earlobe and into an open ended clutch. The earring and clutch remain in place four to six weeks until the hole produced is healed.

Three prior art references, namely U.S. Pat. Nos. 5,004,470, 5,007,918 and 5,263,960 issued to Samuel J. Mann, the contents of which are hereby incorporated by reference, introduced disposable, cartridge housed earrings of several different and random shaped styles featuring enclosure or encapsulation of the earring so that the earring may not be touched before or during the piercing process. The earring clutches are housed in a separate cartridge and are not totally encapsulated, but do, however, make direct contact with the operator difficult, but not impossible. When utilizing these prior art systems, both earring cartridges and clutch cartridges are inserted into a piercing instrument. This piercing instrument is of simple design and retains the cartridge within slide tracks. The earlobe is placed in the gap between the ear piercing earring cartridge and the clutch cartridge. The plunger is displaced into the earring cartridge, ejecting the earring out of the cartridge, through the earlobe, and into the clutch, automatically releasing the clutch from the cartridge, completing the piercing process. In order to form a second piercing hole, both the earring cartridge and clutch cartridge are removed from the instrument, inverted, and the process is repeated. In the system of U.S. Pat. No. 5,004,470 the stud cartridge and clutch cartridge are not removed, but are slid within the car piercing instrument to place the non-ejected earring in piercing position.

These prior art devices have been satisfactory. However, they suffer from the disadvantage that the disposable cartridges which prevent contact between each person and the instrument do not fully cover the piercing area of the instrument itself which is proximate to the earlobe, allowing potential for contamination from blood splash or the like. Additionally, because the cartridge must be inverted or slid by hand by the piercing instrument operator, the cartridges are still excessively handled exposing the cartridges to contamination from the operator and vice versa as well as the susceptibility of being dropped. This is particularly significant when handling the clutch cartridge in which the clutches are exposed to some extent and may even be touched during handling.

In order to overcome these deficiencies, ear piercing apparatuses set forth in U.S. Pat. Nos. 5,390,394 and 5,350,394, issued to Mann, have been proposed, the contents of which are hereby incorporated by reference. In these systems, the piercing earring and clutch are contained in an enclosed system. Therefore, the piercing operation can be performed without the operator contacting the piercing earring or clutch.

However, these prior art systems still have a number of drawbacks. First, the sliding clamp requires a more complicated and costly apparatus. Second, after piercing the user's ear, the piercing earring will not be flush against the user's ear, requiring the user or the person being pierced to reposition the earring after piercing. Additionally, in the prior art cartridge after piercing, the pivoting or sliding clamp will still be holding the ear of the user, trapping the ear in the instrument. Finally, since the cartridge holding the piercing earring is hinged at the back thereof, the cartridge could have a tendency to open prior to its reaching the proper position.

A further deficiency in the prior art ear piercing cartridge assemblies is that the clutch 36 as shown in FIG. 8 is an open back clutch. Piercing pinpoint 55*c* of a piercing earring 55 is exposed and can cause user discomfort. That is, the prior art clutch permits the sharp point of the earring post to protrude past the open ended wings 37 of the clutch 36, thereby causing discomfort to the wearer as the point will contact the skin when the wearer sleeps or places their ear against a surface. Furthermore, for the hole in the earlobe to properly heal an airspace around the ear must be provided. Often the user will intentionally or accidentally push the clutch against the ear preventing air circulation and the resultant proper healing.

Accordingly, an ear piercing instrument and cartridge which eliminates earring handling, reduces the pain associated with the piercing operation, provides easy removal of the piercing instrument after performance of the piercing operation by retracting the capsule, properly locates the piercing earring with respect to the user's ear through a simple, unitary construction and prevents the sharp point of the earring post from contacting the wearer and overcomes the shortcomings of the prior art is desired.

SUMMARY OF THE INVENTION

The present invention provides for a clutch having an interior wall forming a closed back oriented to come into contact with the pointed end of an earring after piercing to prevent further travel of the earring. The clutch consists of a head portion comprising a piercing pin positioning structure within the head portion for guiding a piercing pin within the head portion and preventing the piercing pin from contacting a user when received within the head portion.

The present invention also consists of a clutch cartridge assembly comprising a cavity forming a well with a gel disposed in the well for retaining the clutch therein.

The present invention also consists of a clutch cartridge assembly comprising a cavity forming a well wherein the cavity has a clutch retaining rib or finger for securing a portion of a clutch within the cavity.

The present invention also consists of a an ear piercing apparatus comprising a piercing earring retaining subassembly for releasably supporting a piercing earring; a clutch retaining subassembly for releasably supporting a clutch; a piercing instrument for supporting the ear piercing cartridge assembly therein; a capsule slideably disposed within the piercing earring subassembly for retaining an ear piercing earring therein; and a plunger disposed within the ear piercing instrument, an impingement point being formed on the plunger, the impingement point engaging the capsule to alternatively move the capsule within the saddle region towards and away from the clutch retaining subassembly.

Accordingly, it is an object of the present invention to provide an improved piercing earring cartridge and an ear piercing instrument for use therewith.

Yet another object of the invention is to provide a clutch configured to precisely position the clutch on the piercing earring after the piercing procedure is performed, thus eliminating the protrusion of the earring post from the rear of the clutch and thereby eliminating the potential for pain for the wearer.

Yet another object of the invention is to provide a simple structure for retracting the ear piercing earring cartridge after piercing.

A further object of the invention is to provide a cartridge for a clutch which retains the clutch therein while allowing for easy removal after piercing.

Still other objects and advantages of the invention will in part be obvious and will in part be apparent from the specification.

The invention accordingly comprises the features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, which are not to scale, and which are merely illustrative, and wherein like reference numerals depict like elements throughout several views, and in which:

FIG. 1 is a perspective view of an piercing earring and clutch cartridge mounted to an ear piercing instrument constructed in accordance with the invention;

FIG. 2 is a top plan view of the cartridge and ear piercing instrument constructed in accordance with the invention;

DETAILED DESCRIPTION OF THE PREFERRED EMBODIMENTS

Figures 3, 3A:
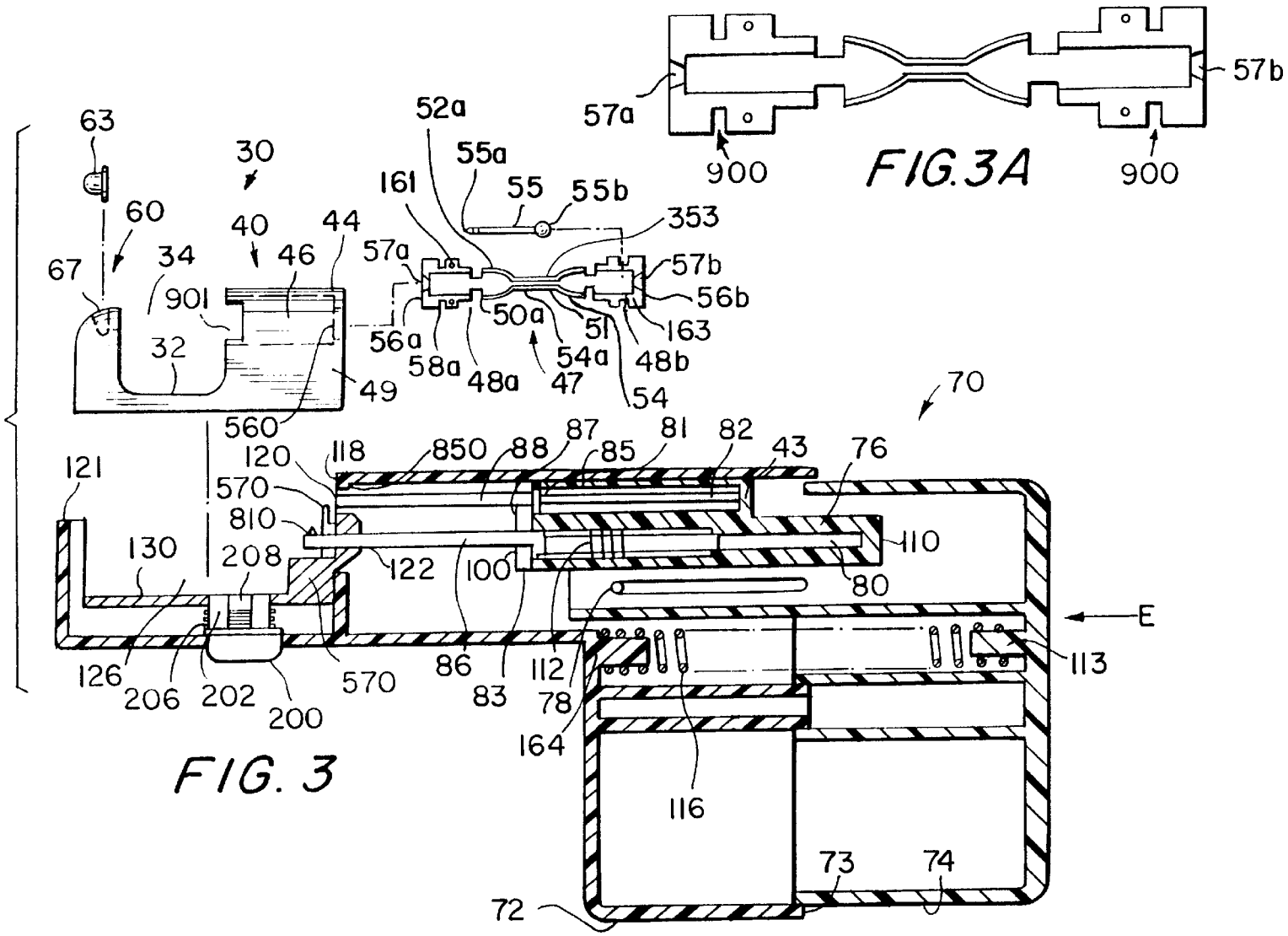
FIG. 3 is an exploded cross-sectional view of the ear piercing instrument, cartridge, and piercing earring containing capsule constructed in accordance with the invention.

Reference is now had to FIG. 1 wherein an ear piercing assembly, constructed in accordance with a preferred embodiment of instant invention, and generally indicated as 20, is depicted. Ear piercing assembly 20 includes a unitary piercing earring and clutch cartridge assembly ("cartridge assembly") generally indicated as 30 and an ear piercing instrument generally indicated as 70. Cartridge assembly 30 further includes an ear piercing earring retaining sub-assembly generally indicated as 40 and a clutch retaining sub-assembly, generally indicated as 60. Ear piercing instrument 70 further includes an actuator 74 and a housing 72.

Housing 72 includes a front wall 118 (FIG. 3) and an anvil 121 forming a saddle region 126 therebetween. A floor 130 is formed in saddle region 126 for supporting cartridge assembly 30 thereon.

Cartridge assembly 30 is formed as an integral molded piece. Earring retaining sub-assembly 40 is separated from clutch retaining sub-assembly 60 by a floor 32 forming a saddle region 34 therebetween. Cartridge floor 32 is formed with an opening 33 formed therein. A hood 44 extends from cartridge floor 32 forming a covering and extends into front support wall 42 of earring retaining subassembly 40. A bore 46 axially extends for the length of hood 44 through front support wall. Ears 560 extend from each side of hood 44. Cartridge 30 is mounted in saddle region 126 of the instrument 70 and is retained in position by ears 560 which are integral with cartridge 30 and which are received within retainer members 570 that are integral with floor 130 of instrument 70. In a preferred embodiment the cartridge is snap fit into saddle region 126.

Figure 14:
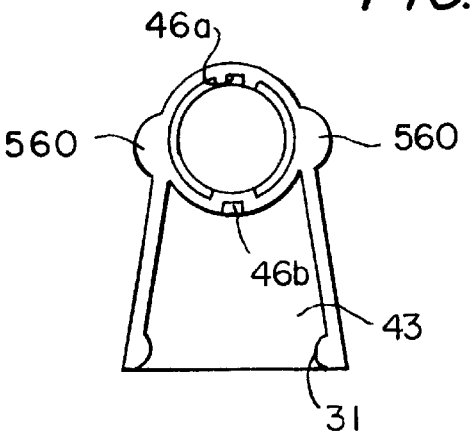
FIG. 14 is an elevational rear view of the cartridge of FIG. 3.

As is seen from FIG. 14, bore 46 is formed with a first guide groove 46*a* and a second guide groove 46*b*. Groove 46*b* has a stop wall 820 therein. A cavity 43 is formed within cartridge 30. Groove 46*b* communicates between bore 46 and cavity 43. Detents 31 extend internally from cartridge side walls of hood 44. Bore 46 has an exit opening 46*c* which is oblate (wider than high) allowing an exiting capsule to separate wider without the increase in overall size of the cartridge, or circular with relieved side walls 901 to allow additional clearance for the opening of capsule 47.

Reference is now specifically made to FIG. 3, wherein an earring capsule 47 formed of two half walls 48*a*, 48*b* connected by a hinge 51 is depicted. In an exemplary embodiment, the half walls forming capsule 47 are molded of a low friction plastic to define a low friction inner surface. Half wall 48*a* is symmetrical with half wall 48*b* and accordingly the following description with respect to half wall 48*a* is identical with respect to half wall 48*b* and each element referred to herein with the lower case letter suffix (a) has a counterpart with the same number and the suffix (b) unless otherwise specified. By way of orientation and to simplify the description of half wall 48*a*, the length thereof is defined herein as being along the axial direction defined by the movement of capsule 47 along bore 46.

As is shown in FIG. 3, half wall 48*a* includes flexible relief slit 50*a*, a spherical wall 52*a* and an elongated channel 54*a* and a rear wall 56*a*. Half walls 48*a* and 48*b* are secured together by hinge 51. When half walls 48*a* and 48*b* are folded together, they, together with the rear walls 56*a* and 56*b*, define a cavity for receiving therein a piercing earring 55 having a piercing pin 55*a* and an earring head 55*b*.

Circular openings 57*a*, 57*b* are formed in rear walls 56*a*, 56*b* respectively, and define an opening 53 for receiving a push rod 88 during the ear piercing operation. Lateral projection 58*a* projects along half wall 48*a* at the rear of capsule 47. During assembly of capsule 47, piercing earring 55 is positioned in one of the half walls 48*a* or 48*b*. Thereafter, half walls 48*a* and 48*b* are folded along hinge 51 so that piercing earring 55 is disposed within capsule 47. Piercing pin 55*a* is positioned to define an interference fit in elongated channels 54*a*, 54*b*. Piercing earring head 55*b* rests against the inside of rear walls 56*a*, 56*b*. Half wall 48*a* is formed with pins 161 extending therefrom. Half wall 48*b* is formed with holes 163 therein dimensioned and positioned to receive pins 161 which are press fit therein. Pins 161, acting in cooperation with holes 163, maintain the rear portion of capsule 47 closed and aligned.

Figure 4:
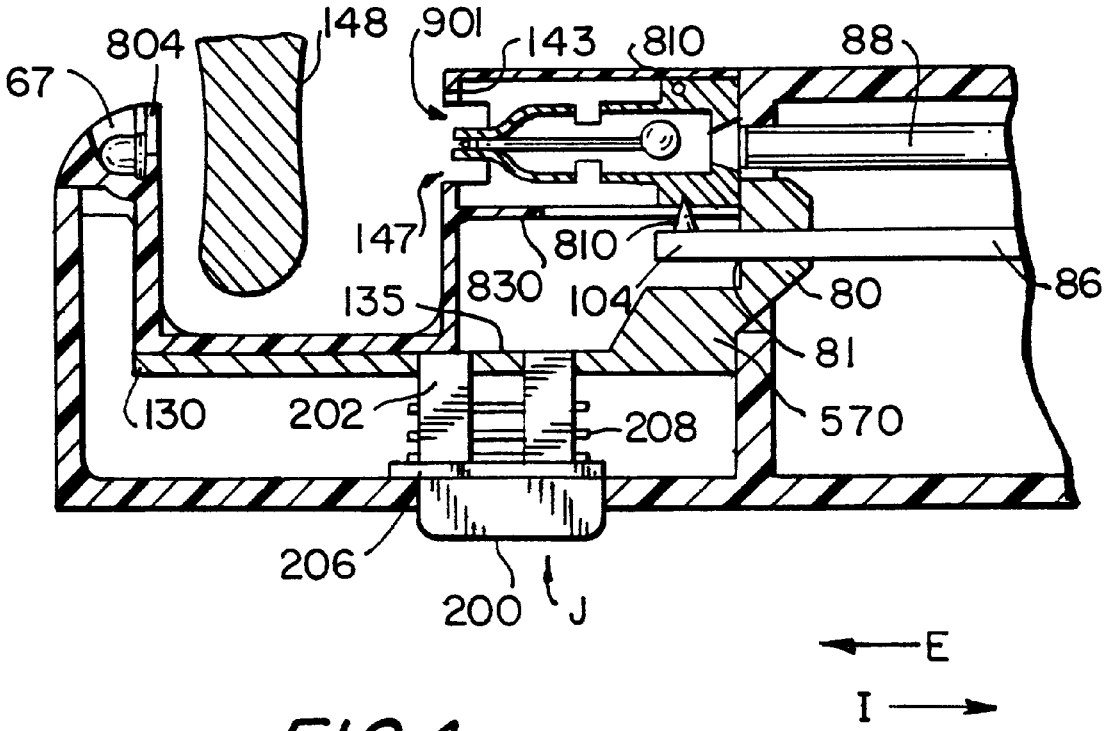
FIG. 4 is an enlarged side cross-sectional view of the cartridge and ear piercing device mounted to an ear piercing instrument prior to piercing and constructed in accordance with the invention.

Capsule 47 is slideably maintained within bore 46. As is further depicted in FIG. 14, lateral projections 58*a*, 58*b* arc slideably positioned within bore 46 by guide grooves 46*a*, 46*b* formed within bore 46, allowing capsule 47 to slide through bore 46 while maintaining capsule 47 oriented within bore 46 and insuring that capsule 47 does not open prior to exiting bore 46. A retaining lip 143 (FIG. 4) extends inwardly i.e., towards the axis of bore 46, forming an exit opening 147 in the ejection direction of bore 46. As seen in FIG. 4, a retaining lip 143 is dimensioned to come in contact with lateral projections 58*a*, 58*b* acting as a stop to prevent the complete ejection of capsule 47 during ear piercing.

Figure 9:
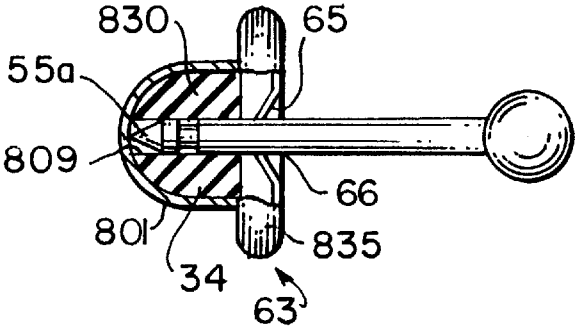
FIG. 9 is a side cross-sectional view of an earring and clutch in accordance with a first preferred embodiment of the present invention.

Clutch 63 may be formed of a single piece of resilient metal, or plastic generally having a derby-shaped configuration (FIG. 9). A blind hole channel 66 is provided in the clutch for receiving piercing pin 55*a* of earring 55. In a preferred embodiment, clutch 63 is derby-shaped and includes a rim portion 835, a head portion 801 forming a blind hole 810 having a blind hole channel 66 and positioning members 65. Piercing pin 55*a* enters blind hole channel 66, is guided by positioning members 65, and continues until it reaches the interior surface 809 of head portion 801. The retention of the earring post 55 to the clutch 63 can be accomplished in several ways, such as, for example, by a rubber or plastic retainer 830 (FIG. 9) forming a hole 809 to accept the post 55 and provide a friction fit therewith.

Figure 10:
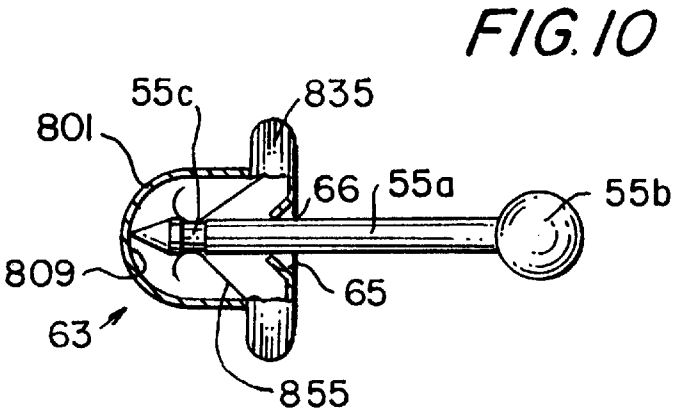
FIG. 10 is a side cross-sectional view of an earring and clutch in accordance with a second preferred embodiment of the present invention.
Figure 11:
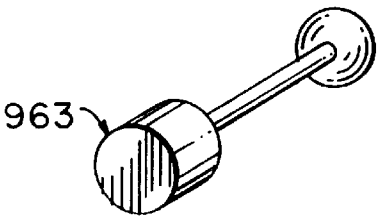
FIG. 11 is a perspective view of an earring and clutch in accordance with a third preferred embodiment of the present invention.
Figure 12:
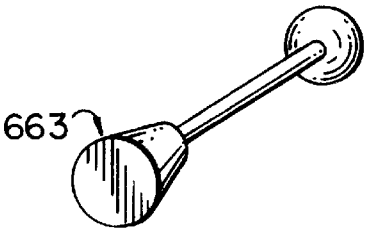
FIG. 12 is a perspective view of an earring and clutch in accordance with a fourth preferred embodiment of the present invention.
Figure 13:
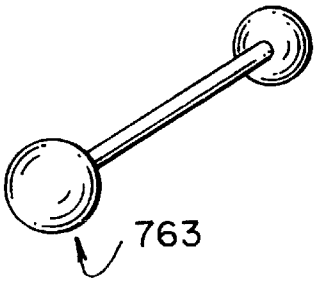
FIG. 13 is a perspective view of an earring and clutch in accordance with a fifth preferred embodiment of the present invention.

In another embodiment, clutch 63 includes a mechanical spring 855 (FIG. 10) to cooperate with a notch 55*c* in post 55 to maintain the piercing pin 55*a* therein. The clutch 63 may be constructed to have a variety of decorative appearances in addition to providing retention. That is, the clutch 63 may be of such geometry to appear as a cylinder 963 (FIG. 11), a truncated shape 663 (FIG. 12) or a ball 763 (FIG. 13), and containing a decorative stone or ornament to enhance the wearers appearance, by way of example, but may be any structure which separates piercing pin 55*d* from the user and holds the clutch onto the piercing pin, as shown in FIGS. 11, 12 and 13.

Figure 17A:
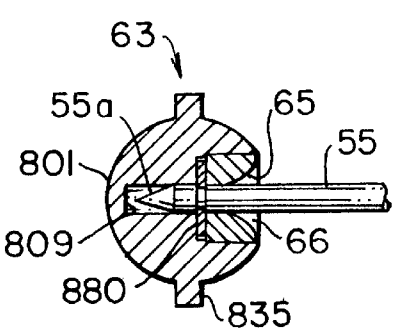
FIG. 17*a* is side cross-sectional view of an earring and clutch in accordance with a seventh preferred embodiment of the present invention.
Figure 17B:
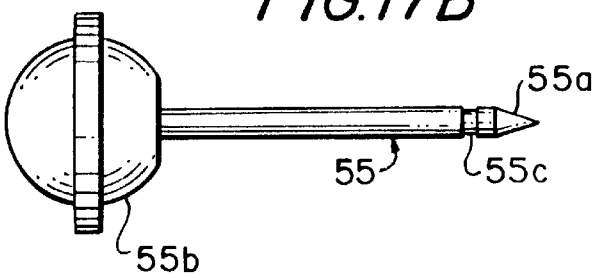
FIG. 17*b* is a side elevational view of an car piercing earring constructed in accordance with the seventh embodiment of the invention.
Figure 18B:
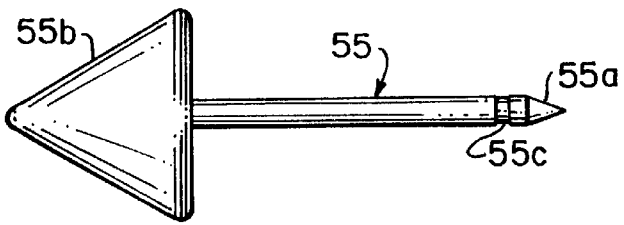
FIG. 18*b* is a side elevational view of an ear piercing earring in accordance with the eighth embodiment of the invention.
Figure 16A:
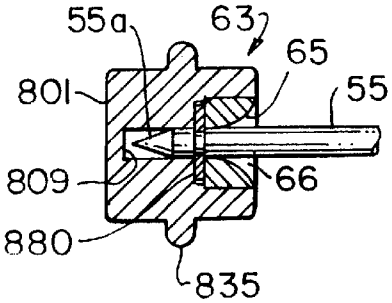
FIG. 16*a* is a side cross-sectional view of an earring and clutch in accordance with a sixth preferred embodiment of the present invention.
Figure 16B:
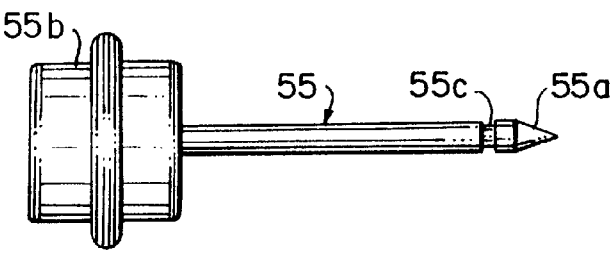
FIG. 16*b* is a side elevational view of an ear piercing earring constructed in accordance with the sixth embodiment of the invention.
Figure 18A:
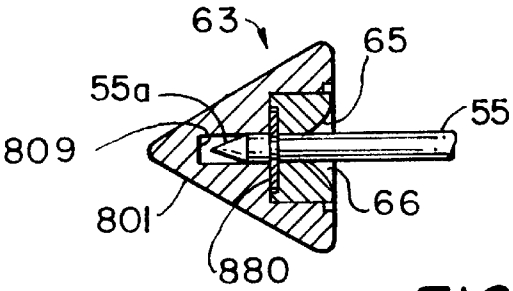
FIG. 18*a* is a side cross-sectional view of an earring and clutch in accordance with a eighth preferred embodiment of the present invention.

In an alternative embodiment, as best seen in FIGS. 16–18, clutch 63 includes a C-shaped clip 880 formed integrally within clutch 63. A blind hole channel 66 is provided in the clutch for receiving piercing pin 55*a* of earring 55. Piercing pin 55*a* enters blind hole channel 66, is guided by positioning members 65 until clip 880 engages notch 55*c*. Clip 880 is constructed to cooperate with notch 55*c* in post 55 to maintain piercing pin 55*a* therein. The clutch 63 may be constructed to have a variety of decorative appearances in addition to providing retention. That is, the clutch 63 may be of such geometry to appear as a cylinder (FIG. 16*a*), saturn-shaped (FIG. 17*a*) or cone-shaped (FIG. 18*a*). Decorative head 55*b* can be constructed with the identical decorative appearances and geometry as its corresponding clutch (see FIGS. 16*b*, 17*b*, 18*b*), thereby providing a symmetrical earring appearance.

Figure 7:
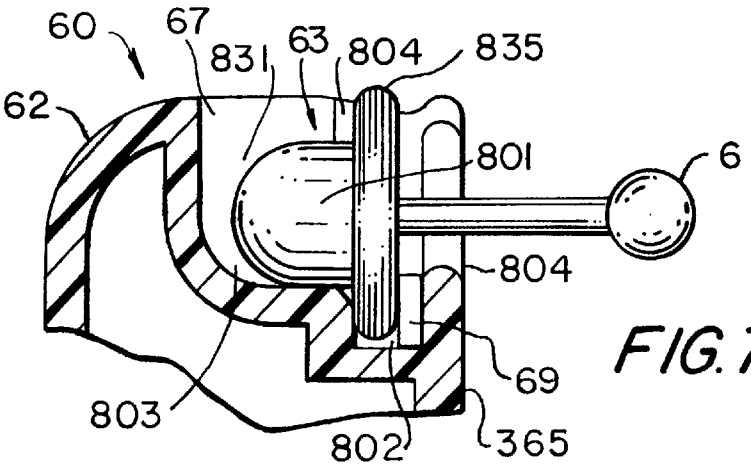
FIG. 7 is an enlarged cross-sectional view depicting the clutch area of the cartridge constructed in accordance with the invention after a piercing operation has been performed.

As best seen in FIG. 7, clutch retaining sub-assembly 60, includes a clutch casing 62. Clutch casing 62 is a solid molded casing integrally formed with floor 32. In a preferred embodiment, clutch casing 62 includes clutch chamber 67 including a rim receiving section 802 and a head receiving portion 803 or other such variations to accommodate various clutch shapes. A groove 804 is formed in cavity 67 for receiving rim 835 therein. Clutch 63 is retained within clutch-retaining sub-assembly 60 by clutch retaining rib 69. Clutch retaining rib 69 projects from rim receiving section 802 to hold rim 835 of clutch 63 in position and secure clutch 63 within clutch chamber 67.

In an alternative embodiment, clutch chamber 67 forms a well for receiving a high viscosity gel 831 therein which may be used to maintain clutch 63 therein. The gel need not be used when a portion of the clutch can be received in rim receiving section 802 and held by rib 69. However, the gel will be used where the shape of the clutch will not lend itself to being maintained in rim receiving section 802.

Clutch retaining sub-assembly 60 is further formed with a vertically extending rigid wall 365 spaced a predetermined distance from an entrance 804 to clutch chamber 67. Wall 365 supports the ear and establishes a distance between the clutch and earlobe. Piercing pin 55*a* passes rigid wall 365 and engages clutch 63.

Reference is now made to FIG. 3 in which ear piercing instrument 70 is shown as including housing 72 having actuator 74 slideably received therein through an opening 73 and a plunger assembly housing 76. Plunger assembly housing 76 is maintained within housing 72 by an anchor pin 78. Housing 72 is defined by a front wall 118 having push rod opening 120 and a plunger opening 122 formed therein.

Plunger assembly housing 76 includes plunger 86 and push rod 88, which are slideably mounted within plunger assembly housing 76. Plunger assembly housing 76 is formed with a first bore 80 having plunger 86 slideably mounted therein. An impingement point 810 is formed on a distal end 104 of plunger 86. A second bore 82 parallel with bore 80 is formed in plunger assembly housing 76 for slideably supporting push rod 88 therein. Bore 80 is formed with an opening 81. Opening 81 has a diameter less than bore 80 forming a shoulder 83 within bore 80. Similarly, an opening 85 of bore 82 has a diameter less than bore 82 forming a shoulder 87.

Pressure on actuator 74 pushes plunger assembly housing 76 towards opening 120. Because the front of bore 82 is anchored, push rod 88 slides through bore 82 as actuator 74 is pushed.

Figure 15:
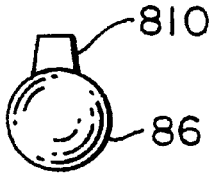
FIG. 15 is an elevational front view of the plunger of the ear piercing instrument constructed in accordance with the invention.

Referring to FIGS. 4 and 15, in a preferred embodiment, impingement point 810 of plunger 86 is a sharp point for penetrating lateral projections 58*a* and 58*b* of capsule 47 upon insertion of the cartridge assembly 30. Upon activation of the actuator 74, the capsule 47 containing the earring 55 is driven forward by impingement point 810 of plunger 86, at which time the push rod 88 is advanced forward also, but does not enter the rear hole 53 of the capsule 47. Capsule 47 is advanced forward until either lateral projections 58*a* and 58*b* are stopped by retaining lip 143, or when impingement point 810 of plunger 86 contacts the stop wall 820 of cartridge 30, whereupon the push rod 88 will enter opening 53 of capsule 47. Plunger 86, which is biased by spring 112, is prevented from traveling further forward by wall 820 in the lower portion of the cartridge 30. Push rod 88 has a smaller diameter than opening 53 which provides a smooth transition into the interior of the capsule 47 for pushing forward the earring 55.

As seen in FIG. 19, capsule 47 alternatively may be provided with gaps 900 in projections 58*a* and 58*b* to allow point 810 on shaft 86 to easily enter rather than forcefully impinge the plastic material. This reduces the pressure required to insert the capsule 30 onto the instrument and provides for an interlocking engagement. Capsule 47 may also have mutually opposing fingers 905 formed on an inside surface of the capsule to aid in preventing smaller sized earrings from becoming dislodged from the capsule 47 during transport. Fingers 905 are formed of a generally elastic or bendable material to permit push rod 88 to proceed past fingers 905 and push earring 55 out of capsule 47 during operation.

The halves of capsule 47 are thereafter parted at hinge 51 and are displaced outwards about the flexible portion 50*a*, allowing the decorative head 55*b* of the earring to be released from the halves of the capsule 47. Upon releasing pressure on actuator 74, because impingement point 810 of plunger 86 is still embedded in the lateral projections 58*a* and 58*b* of capsule 47, capsule 47 will return back into the bore 46 allowing the decorative head 55*b* to be free of the capsule 47. Upon return of capsule 47 to its initial position, the instrument 20 is lowered down and away from the ear that has been pierced, releasing the clutch 63 from the clutch retaining sub-assembly. Additionally, impingement point 810 will retract capsule 47 back to its original position at any point during operation. Thus, by way of example, if a piercing operation is begun and the operator determines that the earring is improperly aimed, the capsule may be retracted and the operation begun again after re-aiming the capsule.

Not all ear piercing earrings 55 are of the identical length. Accordingly, for longer earrings, during operation push rod 88 need not extend all the way from housing 72 during, the piercing operation. Once piercing pin 55*a* contacts the rear of blind hole channel 66 in clutch 63 by way of example, the position of piercing pin 55*a* is fixed relative to clutch 63.

Plunger 86 has spring 112 for biasing plunger 86 towards opening 122. In a preferred embodiment spring 112 has less of a biasing force than spring 102. Spring 112 prevents plunger 86 from exerting too great a force against capsule 47. Plunger 86 moves within cavity 43 and impingement point 810 passes through guide groove 46*b* and contacts capsule 47. At this time car 148 is positioned against rigid wall 365 of clutch retaining sub-assembly 60. The movement of capsule 47 will be stopped when lateral projections 58*a* and 58*b* contact lip 143. As actuator 74 is continually compressed, spring 112 becomes compressed. Spring 112 absorbs the excess drive force which otherwise would be applied to capsule 47 by plunger 86. As is shown in FIG. 3, actuator 74 has a spring for biasing actuator 74 away from house 72 returning actuator 74 to a non-actuating position.

Ejector 200 is a substantially U-shaped member and includes contact arms 202. Flanges 206 extend from either side of base 204 preventing ejector 200 from passing entirely through housing 72. A spring 208 disposed between platform 130 and flanges 206 biases ejector 200 away from platform 130. Ejector arms 202 extend through slot 135 of platform 130 so that when button 200 is pressed in the direction of arrow J (FIG. 4) contact arms 202 come in contact with cartridge assembly 30, lifting cartridge assembly 30 from ear piercing instrument 70 by causing disengagement of snaps 560 from retaining members 570.

Reference is now made to FIGS. 5, 7, 8 and 9 in further explaining operation of ear piercing instrument 20. Prior to operation, piercing earring 55 is placed within half wall 48*b* of capsule 47. Half wall 48*a* is then rotated about hinge 51. Capsule 47 is then placed within earring retaining subassembly 40. A clutch is placed within clutch retaining subassembly 60. The entire cartridge is sterilized and shipped. At the site of application, cartridge 30 is placed within saddle region 126 of instrument 70 and detents 31 engage retaining members 570.

Figure 5:
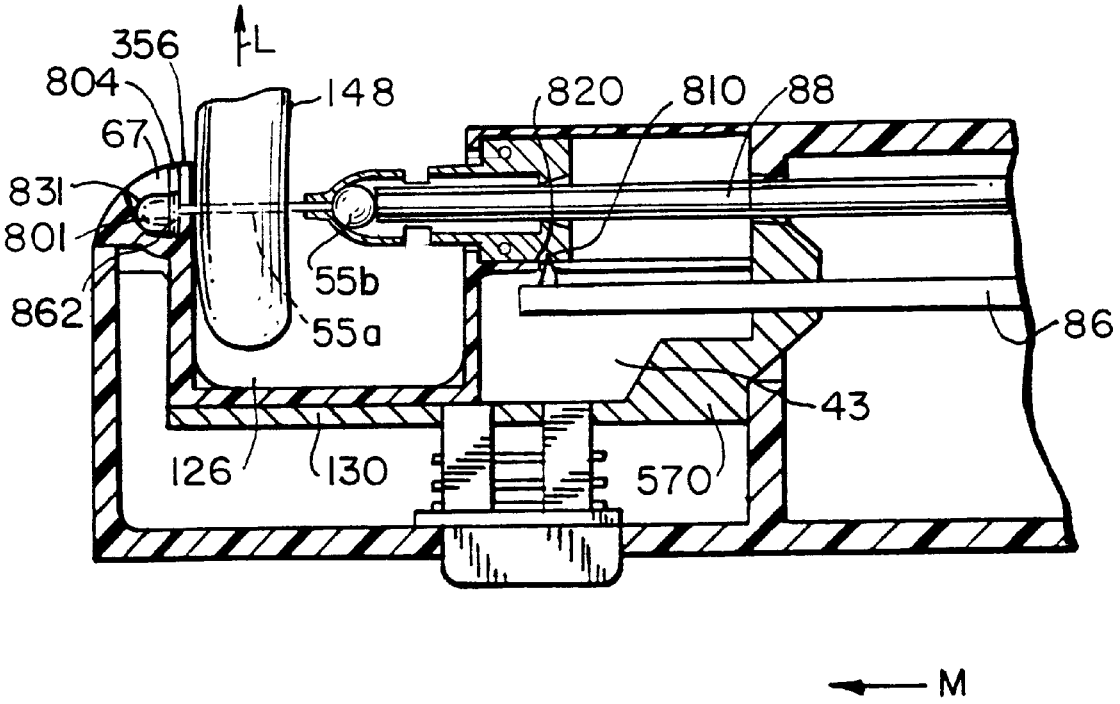
FIG. 5 is an enlarged side cross-sectional view of the cartridge and ear piercing device mounted to an ear piercing instrument after piercing and constructed in accordance with the invention.
Figure 6:
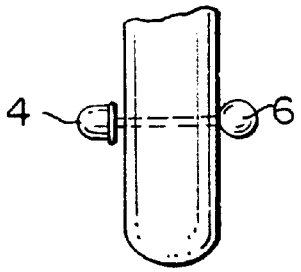
FIG. 6 is a side elevational view depicting an earring fixed within a user's ear after a piercing operation has been performed.
Figure 8:
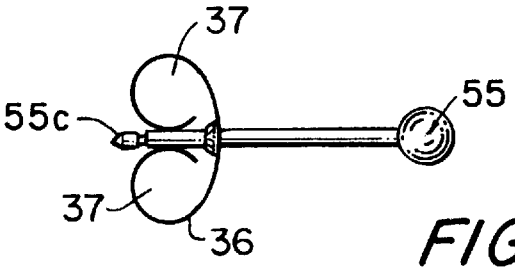
FIG. 8 PRIOR ART
FIG. 8 is a side cross-sectional view of an earring and clutch in accordance with the prior art.

When cartridge 30 is in saddle region 126, push rod 88 is coaxial with hole 53 formed within capsule 47 and blind hole channel 66 of clutch 63. Plunger 86 extends farther than push rod 88 and leads push rod 88 as actuator 74 is actuated. A squeezing pressure is applied on actuator 74 moving actuator 74 through opening 73 into housing 72. As actuator 74 moves into housing 72, a force is provided in the direction of arrow E causing plunger 86 and push rod 88 to move in the direction of arrow E. During activation of ear piercing instrument 70, plunger 86 extends through plunger opening 122 into cavity 43 and engages capsule 47 via impingement point 810 passing through guide channel 46*b*. Prior to use, capsule 47 is in a position shown in FIG. 4. Impingement point 810 causes plunger 86 to push capsule 47 in the direction of arrow M towards clutch retaining subassembly 60, as is shown in FIG. 5. During this movement, capsule 47 is guided through bore 46 by tracks (not shown) engaging projections 58*a*, 58*b*.

As is shown in FIG. 5, plunger 86 will continue to push capsule 47 in the direction of arrow M until lateral projections 58*a* and 58*b* contact lip 143. Lateral projections 58*a* and 58*b* and lip 143, as well as stop wall 820 prevents plunger 86 from pushing capsule 47 too far, and spring 112 prevents plunger 86 from pushing capsule 47 with too great a force, preventing discomfort to ear 148.

The forward force exerted by actuator 74 causes push rod 88 to contact head 55*b* of the earring, driving the point 55*a* through the ear 148 and into the blind hole channel 66 of the clutch 63. Further pressure forces the point 55*a* past positioning members 65 until point 55*a* comes into contact with internal surface 809 of the clutch as shown in FIG. 9, thereby preventing further travel. As capsule 47 slides within bore 46 lateral projections 58*a* and 58*b* slide within tracks (not shown) which, along with hinge 51, keep capsule 47 closed preventing premature ejection of the ear piercing earring until capsule 47 extends from bore 46 towards ear 148. Elongated channel 54 formed at the front traveling end of capsule 47 aids in aiming capsule 47 towards ear 148, and in maintaining capsule 47 in a closed position during movement.

As is shown in FIG. 5, as actuator 74 is continually squeezed, plunger 86 continues to slide capsule 47 through bore 46 until lateral projections 58*a*, 58*b* contact retaining lip 143 stopping further sliding of capsule 47. As actuator 74 is continuously moved within housing 72, the force on push rod 88 causes push rod 88 to move through opening 53 formed by indentations 57*a*, 57*b*.

Push rod 88 comes in contact with ear piercing earring head 55*b* pushing ear piercing earring head 55*b* through capsule 47 causing the tapered walls 52*a*, 52*b* to separate. Flexible relief slits 50*a*, 50*b* provide flexure as tapered walls 52*a*, 52*b* are opened by the earring head 55*b*, thereby providing clearance to allow separation of tapered walls 52*a*, 52*b*. Elongated channel 54 guides earring 55 towards ear 148. Piercing pin 55*a* pierces ear 148 and is guided by positioning members 65 of clutch 63 and contacts the rear of blind hole channel 66. The inner surface 809 of head 801 acts as a stop to piercing pin 55*a*. Clutch 63 can also be fixed at notch 55*c* of piercing earring 55 as shown in FIG. 10.

Actuator 74 is then released. Spring 116 provides a biasing force pushing actuator 74 out from housing 72. Plunger 72 is coupled to actuator 74 by way of plunger housing 76 and push rod 88 is affixed to actuator 72 by way of housing 76 so that as actuator 74 moves in a direction opposite to that of arrow E, plunger 86 and push rod 88 are withdrawn into housing 72. Push rod 88 retracts back into its starting position. As plunger 86 is withdrawn, impingement point 810, which is still engaged to the bottom of capsule 47, returns capsule 47 in the direction of arrow I within bore 46. Capsule 47 is closed as it retracts within bore 46. Once rear wall 56*a*, 56*b* contacts front wall 118, capsule 47 is prevented from moving any further in the direction of arrow I. Cutouts 901 on sides of bore 46 provide additional clearance for retracting capsule 47 back into bore 46.

Because cavity 67 forms an open topped well, clutch 63 is easily removed from clutch cavity 67 when ear 148 is removed from saddle region 34. The retaining force of gel 831 and/or rib 69 is easily overcome in the direction of arrow L. Gel 831 and rib 69 only provide sufficient force to prevent clutch 63 from falling from cavity 67 when jostled or turned upside down. When piercing earring 55 has been ejected, the spent cartridge is ejected from housing 72 by pressing on ejector 200. This causes cartridge assembly 30 to become dislodged from housing 72 so that if the operator is performing ear piercing near a disposal site, such as a trash receptacle, the operator merely activates the ejector by pressing button 200 to drop the cartridge into the trash receptacle without touching the used cartridge, further preventing cross contamination to the ear piercing operator. Spring 208 returns ejector 200 to a non-ejecting position.

It should also be noted as seen from FIGS. 1, 2 and 3, cartridge 30 surrounds and extends beyond saddle region 126 of ear piercing instrument 70. Accordingly, by being dimensioned to be at least coextensive with platform 130 and front wall 118, cartridge 30 acts as a splash shield substantially removing any chance of blood or body fluid splattering against ear piercing instrument 70 to be transmitted to the next user of the ear piercing instrument 70.

In the above example the cavity formed is part of a unitary clutch/piercing pin cartridge. However, the clutch cavity described above may be used in a separate clutch cartridge.

By providing a clutch with a housing portion which is closed ended or effectively surrounds the piercing pin, a clutch which separates the sharp piercing pin from the user is provided, thus removing a major source of discomfort to the piercing process as well as the use thereafter. By providing a cavity in a clutch cartridge which retains the clutch therein utilizing a high viscosity gel or a rib, a simple structure which allows for holding a clutch with a novel head is provided. By providing an oblate opening, or side cut-outs on the cartridge at the exit opening of the bore, wider separation of the capsule is provided to allow a smoother piercing.

It will thus be seen that the objects set forth above, among those made apparent from the previous description, are efficiently obtained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims cover all the generic and specific features of the invention herein described and all statements of the scope of the invention which, as a matter of language might be said to fall therebetween.

What is claimed is:

1. A clutch for a piercing earring having a piercing pin, the clutch comprising:

a head portion having a deformable resilient retaining material therein, said retaining material having a blind hole channel therein; and said blind hole channel having a diameter smaller than a diameter of said piercing pin;

said piercing pin having a waist portion having a diameter smaller than the diameter of said piercing pin, said retaining material expanding into said waist portion when said piercing pin is inserted within said blind hole channel.

2. An ear piercing apparatus comprising:

a piercing earring retaining subassembly for releasably supporting a piercing earring;

a clutch retaining subassembly for releasably supporting a clutch;

a piercing instrument for supporting said ear piercing cartridge assembly therein;

a capsule slideably disposed within said piercing earring subassembly for retaining an ear piercing earring therein; and a plunger disposed within said ear piercing instrument, an impingement point being formed on said plunger, said impingement point engaging said capsule to move said capsule within said saddle region towards said clutch retaining subassembly.

3. The ear piercing apparatus of claim 2, wherein said impingement point engages said capsule within said piercing earring retaining subassembly through a groove in said saddle region, said piercing earring retaining subassembly having a stop wall for engaging said impingement point when said capsule has traveled a predetermined distance.

4. The ear piercing apparatus of claim 3, wherein said capsule is movable between a first and a second position.

5. The ear piercing apparatus of claim 4, wherein said impingement point returning said capsule to said first position.

6. The ear piercing apparatus of claim 2, wherein said piercing earring retaining subassembly comprises mutually opposing fingers to prevent dislodgment of said piercing earring from said piercing earring retaining subassembly during transport.

* * * * *